US007120964B2

(12) United States Patent
Roney

(10) Patent No.: US 7,120,964 B2
(45) Date of Patent: Oct. 17, 2006

(54) BARE FLOOR SHIFTER FOR VACUUM CLEANER

(75) Inventor: Jeffrey T. Roney, Stanford, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 465 days.

(21) Appl. No.: 10/472,833

(22) PCT Filed: Apr. 10, 2002

(86) PCT No.: PCT/US02/11290

§ 371 (c)(1),
(2), (4) Date: Sep. 22, 2003

(87) PCT Pub. No.: WO02/082965

PCT Pub. Date: Oct. 24, 2002

(65) Prior Publication Data

US 2004/0117942 A1 Jun. 24, 2004

Related U.S. Application Data

(60) Provisional application No. 60/282,770, filed on Apr. 10, 2001.

(51) Int. Cl.
*A47L 9/04* (2006.01)

(52) U.S. Cl. ..... 15/391; 15/390

(58) Field of Classification Search ..... 15/366, 15/389, 390, 391
See application file for complete search history.

(56) References Cited

U.S. PATENT DOCUMENTS

| | | | | |
|---|---|---|---|---|
| 4,380,846 | A * | 4/1983 | Maurer | 15/391 |
| 4,446,595 | A * | 5/1984 | Nakada et al. | 15/390 |
| 4,648,150 | A | 3/1987 | Morishita et al. | |
| 4,748,714 | A | 6/1988 | Tschudy | |
| 5,537,712 | A | 7/1996 | Weber et al. | |
| 6,067,689 | A | 5/2000 | Roney et al. | |
| 6,098,243 | A | 8/2000 | Kim | |
| 6,131,238 | A * | 10/2000 | Weber et al. | 15/391 |
| 6,209,168 | B1 * | 4/2001 | Brickner et al. | 15/390 |

FOREIGN PATENT DOCUMENTS

GB 2365758 A 2/2002

* cited by examiner

*Primary Examiner*—Theresa T. Snider
(74) *Attorney, Agent, or Firm*—King & Schickli, PLLC

(57) ABSTRACT

A bare floor switch assembly for a power head or an upright vacuum cleaner includes a mounting bracket, an idler and idler arm pivotally mounted to the mounting bracket, a biaser for biasing the idler and idler arm to an agitator drive interrupting position and a switch body for engaging and locking the idler arm into an agitator driving position.

61 Claims, 8 Drawing Sheets

20
10
18
22
32
12
16
46
46
35
50
34
14
30
38a
36
38b

BARE FLOOR SHIFTER FOR VACUUM CLEANER

This is a U.S. National Stage Application of International Patent Application Ser. No. PCT/US02/11290 filed Apr. 10, 2002 which claims the benefit of U.S. Provisional Application Ser. No. 60/282,770 filed Apr. 10, 2001.

TECHNICAL FIELD

The present invention relates generally to the vacuum cleaner field, and, more particularly, to a bare floor shifter assembly and a power head or an upright vacuum cleaner incorporating such an assembly.

BACKGROUND OF THE INVENTION

Upright vacuum cleaners in all of their designs and permutations have become increasingly popular over the years. The upright vacuum cleaners generally incorporate a nozzle assembly and a canister assembly pivotally mounted to the nozzle assembly which ride on wheels over the floor surface to be cleaned. The canister assembly includes an operating handle that is manipulated by the user to move the vacuum cleaner to and fro across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

While a rotary agitator is very beneficial in efficiently and effectively cleaning the pile of a carpet, it is at a disadvantage when trying to clean a bare floor such as a tile, hardwood, vinyl floor covering or other smooth surface flooring. Specifically, the rapid rotary motion of the agitator generates air currents that are often sufficiently strong to push light dirt and debris (e.g. dog and cat hair) away from the intake nozzle. Thus, under certain operating conditions, a rotary agitator may actually interfere with efficient cleaning.

In order to avoid this problem, many upright vacuum cleaners are equipped with bare floor cleaning switches that allow the operator to interrupt power to the agitator. The stationary agitator does not generate the air currents noted above and as a consequence, light dirt and debris on the bare floor is quickly and efficiently drawn by the fan and motor arrangement from the floor into the nozzle of the vacuum cleaner.

The present invention relates to an improved bare floor cleaning switch assembly of relatively simple and inexpensive construction that provides reliable and dependable operation over a long service life. Such a switch may not only be used in an upright vacuum cleaner but also a power head of a canister vacuum cleaner or even in an extractor.

SUMMARY OF THE INVENTION

In accordance with the purposes of the present invention as described herein, a bare floor switch assembly is provided for an upright vacuum cleaner, a power head of a canister vacuum cleaner equipped with a powered rotary agitator or an extractor. The bare floor switch assembly includes a mounting bracket that is secured to the housing of the vacuum cleaner and more specifically, the nozzle assembly of the housing. The bare floor switch assembly also includes an idler (such as a pulley) and idler arm pivotally mounted to the mounting bracket and displaceable between a first, rotary agitator drive-disengaging position and a second, rotary agitator drive-engaging position. A biaser engages the idler arm and biases the idler pulley and idler arm to the first, rotary drive-disengaging position. A switch body is pivotally mounted to the mounting bracket. The switch body includes a projecting finger for engaging and locking the idler pulley and idler arm in the second, rotary agitator drive-engaging position.

More specifically describing the invention, the idler pulley and idler arm includes and carries an arcuate leaf spring. The leaf spring includes a proximal end secured in a socket or slot on the idler arm and a free distal end. The finger of the switch body engages a face of the arcuate leaf spring. The finger includes a rounded tip allowing it to slide along the face of the arcuate leaf spring and move "over center" to lock the idler pulley and idler arm in the second, rotary agitator drive-engaging position.

The mounting bracket includes a base and a pair of upstanding posts. The switch body includes a pair of spaced mounting skirts. The projecting finger extends between the pair of upstanding posts and the upstanding posts are received in a pair of cooperating cavities in the switch body between the projecting finger and the mounting skirts. A pivot pin is received in cooperating aligned apertures in the pair of spaced mounting skirts, the projecting finger and the pair of spaced upstanding posts in order to provide the pivotal connection between the switch body and the mounting bracket.

A switch plate fascia is carried at the top of the switch body. A fastener such as a screw secures the switch plate fascia to the switch body. The switch plate fascia provides an aesthetically pleasing structure that may be easily engaged with the operator's hand/finger or foot/toe to interrupt power to the agitator to allow more efficient bare floor cleaning or to engage power to the agitator for more efficient cleaning of carpet pile.

In accordance with yet another aspect of the present invention, an upright vacuum cleaner is provided with a bare floor switch assembly as just described.

In the following description there is shown and described one possible embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIG. 3*b* is a view similar to FIG. 3*a* but with the idler pulley released and the agitators disengaged for interruption of drive to the agitators and bare floor cleaning;

FIG. 4 is an exploded perspective view of the gear drive assembly with the two intermediate gear arrangement to provide counter-rotating agitators;

FIG. 4*a* is a side elevational partially schematic view showing the rotary motion of the gears and agitators;

Figure 1:
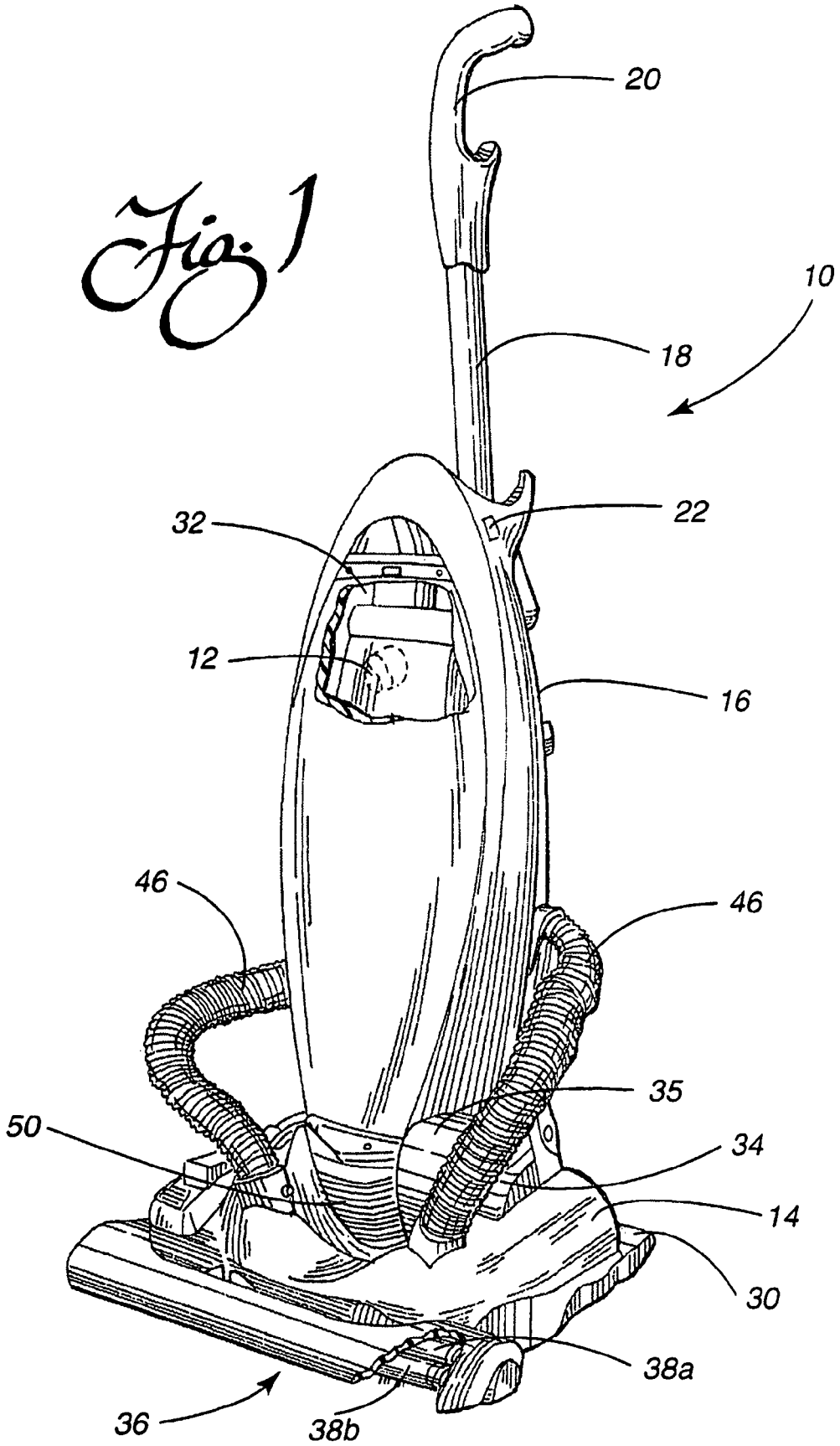
FIG. 1 is a perspective view of an upright vacuum cleaner of the present invention.

Reference will now be made in detail to the present invention, an example of which is illustrated in the accompanying drawing.

DETAILED DESCRIPTION OF THE INVENTION

Reference is now made to FIGS. 1, 2 and 3*a*–3*c* showing an upright vacuum cleaner 10 incorporating the bare floor switch assembly 11 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through a cord (not shown).

A pair of rear wheels (not shown) are provided at the lower portion of the canister assembly 16 and a pair of front wheels (not shown) are provided on the nozzle assembly 14. Together, these wheels support the vacuum cleaner 10 for movement across the floor. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated to-and-fro to clean the floor.

The canister assembly 16 includes a cavity 32 adapted to receive and hold a dust bag 12. Alternatively, the vacuum cleaner 10 could be equipped with a dust collection cup such as found on cyclonic type models if desired. Additionally, the canister assembly 16 carries a suction fan 34 and suction fan drive motor 35. Together, the suction fan 34 and its cooperating drive motor 35 function to generate a vacuum airstream for drawing dirt and debris from the surface to be cleaned. While the suction fan 34 and suction fan drive motor 35 are illustrated as being carried on the canister assembly 16, it should be appreciated that they could likewise be carried on the nozzle assembly 14 if desired.

The nozzle assembly 14 includes a nozzle and agitator cavity 36 that houses a pair of rotating agitator brushes 38*a* and 38*b*. The agitator brushes 38*a* and 38*b* shown are rotatably driven by the drive motor 35 through a cooperating belt and gear drive system 60 shown best in FIGS. 2, 3*a* and 3*b* and described in detail below. In the illustrated vacuum cleaner 10, the scrubbing action of the rotary agitator brushes 38*a*, 38*b* and the negative air pressure created by the suction fan 34 and drive motor 35 cooperate to brush and beat dirt and dust from the nap of the carpet being cleaned and then draw the dirt and dust laden air from the agitator cavity 36 to the dust bag 12. Specifically, the dirt and dust laden air passes serially through hoses 46 and/or an integrally molded conduit in the nozzle assembly 14 and/or canister assembly 16 as is known in the art. Next, it is delivered into the dust bag 12 which serves to trap the suspended dirt, dust and other particles inside while allowing the now clean air to pass freely through to the suction fan 34, pass over the motor 35, through a final filtration cartridge (not shown) and ultimately to the environment through the exhaust port 50.

Figure 2:
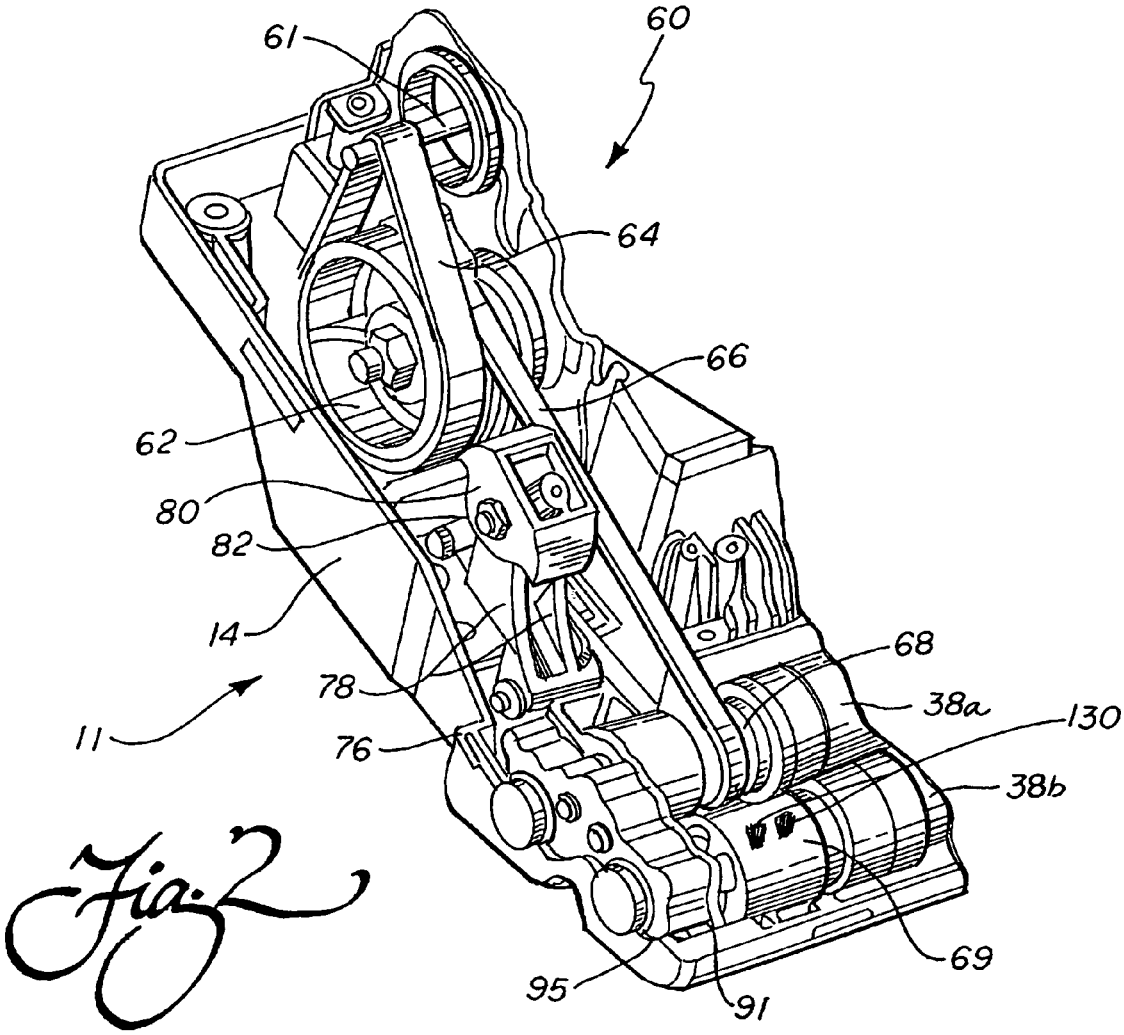
FIG. 2 is an overall detailed perspective view of the agitator drive system of that vacuum cleaner.
Figure 3A:
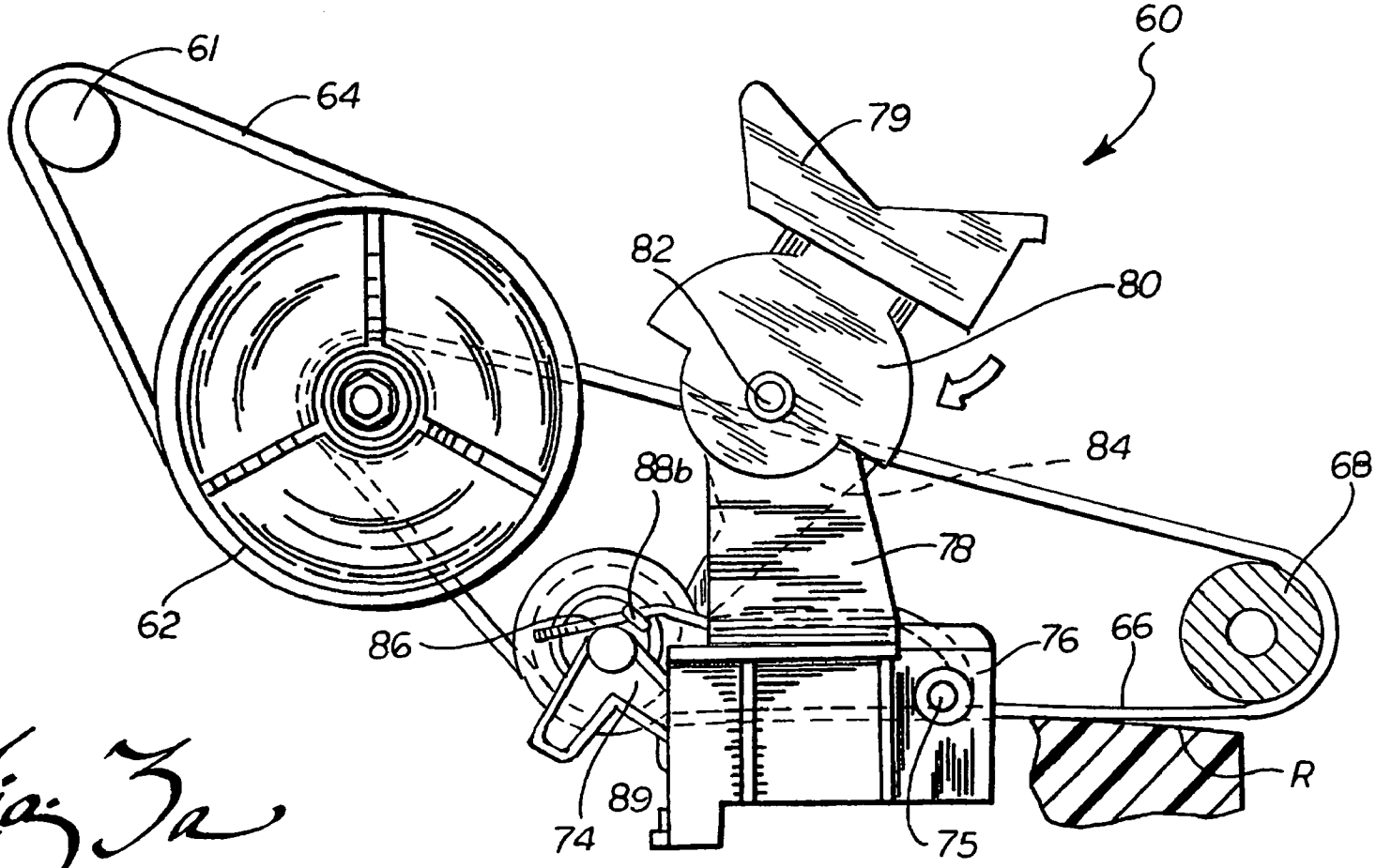
FIG. 3*a* is a partially schematic side elevational view of the agitator drive system with the idler pulley tensioning the belt and the agitators engaged for rotary operation.
Figure 7B:
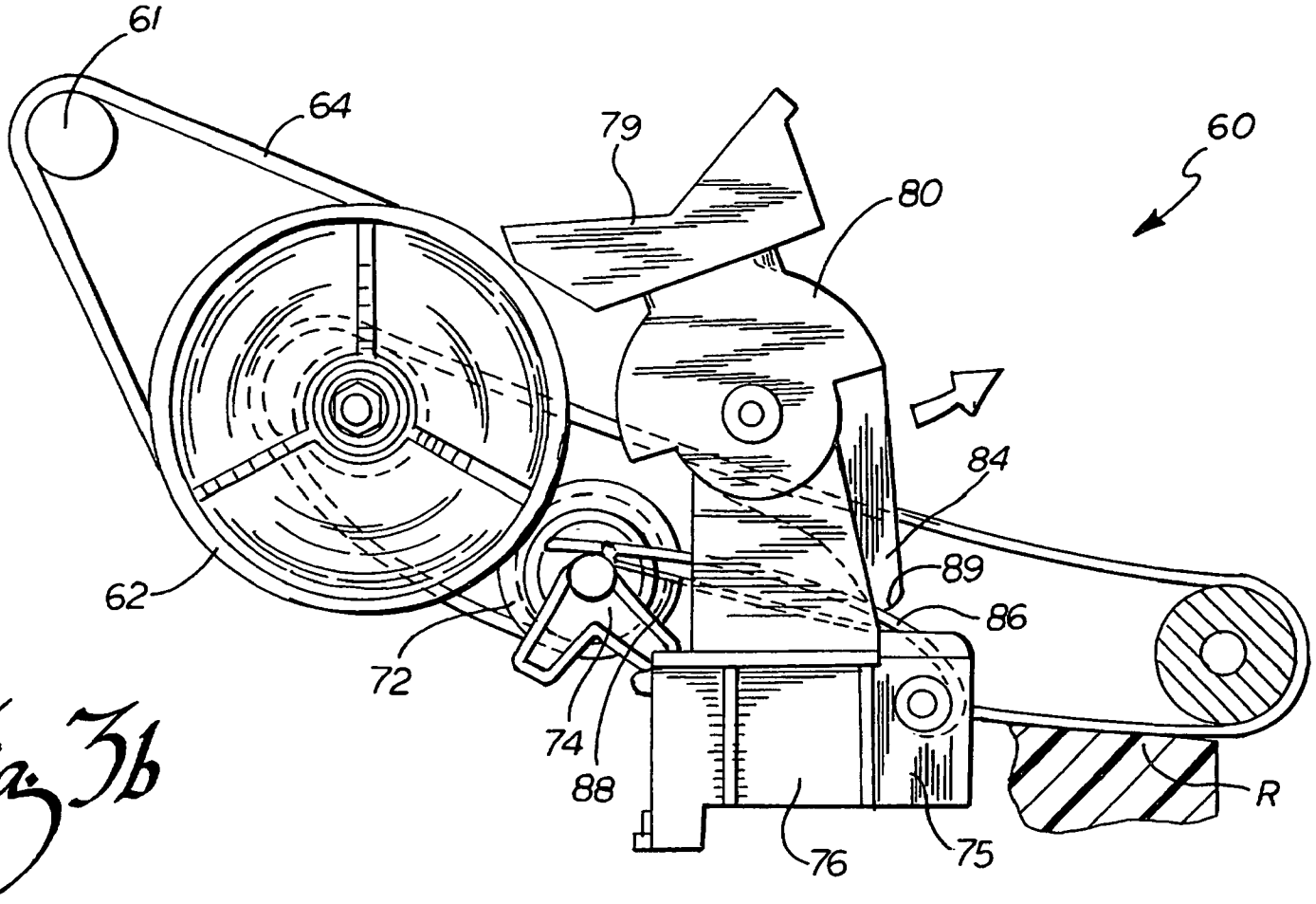

The agitator drive system or arrangement 60 shown best in FIGS. 2, 3*a* and 3*b* includes a drive shaft 61 connected to the drive motor 35 that turns the suction fan 34. Drive shaft 61 is connected by a first belt 64 to a dual drive pulley 62 carried for relative rotation on the nozzle assembly 14. A second belt 66 connects the pulley 62 to the agitator pulley 68 carried on the first rotary agitator 38*a*. The dual drive pulley 62 provides a speed reduction so that the rotary agitator 38*a* is driven at optimal speed while the drive motor 35 simultaneously turns the suction fan 34 at the necessary high RPM to generate the desired negative pressure for vacuum cleaning.

Figure 3C:
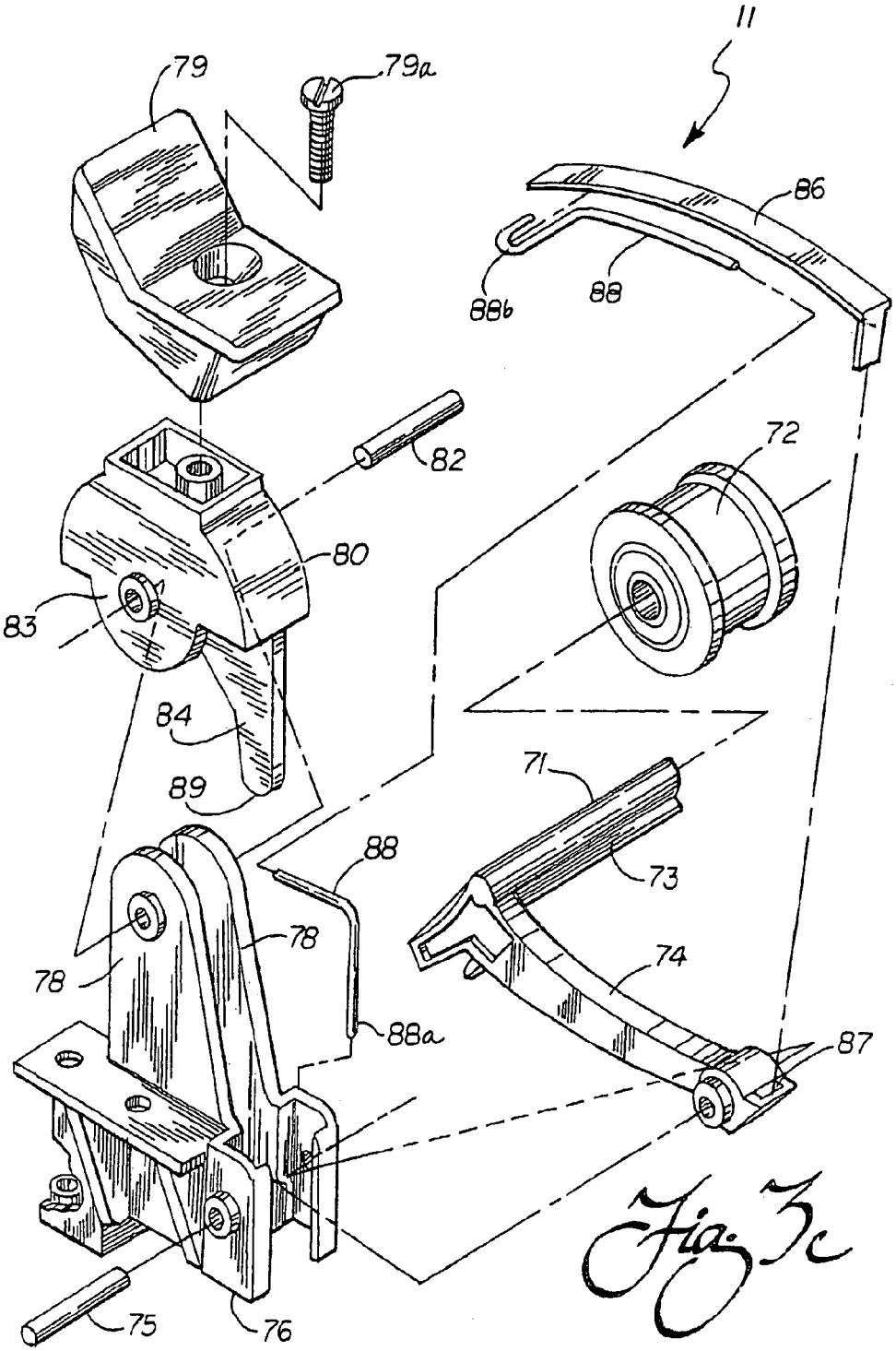
FIG. 3*c* is a detailed exploded perspective view of the bare floor switch assembly.
Figure 24:
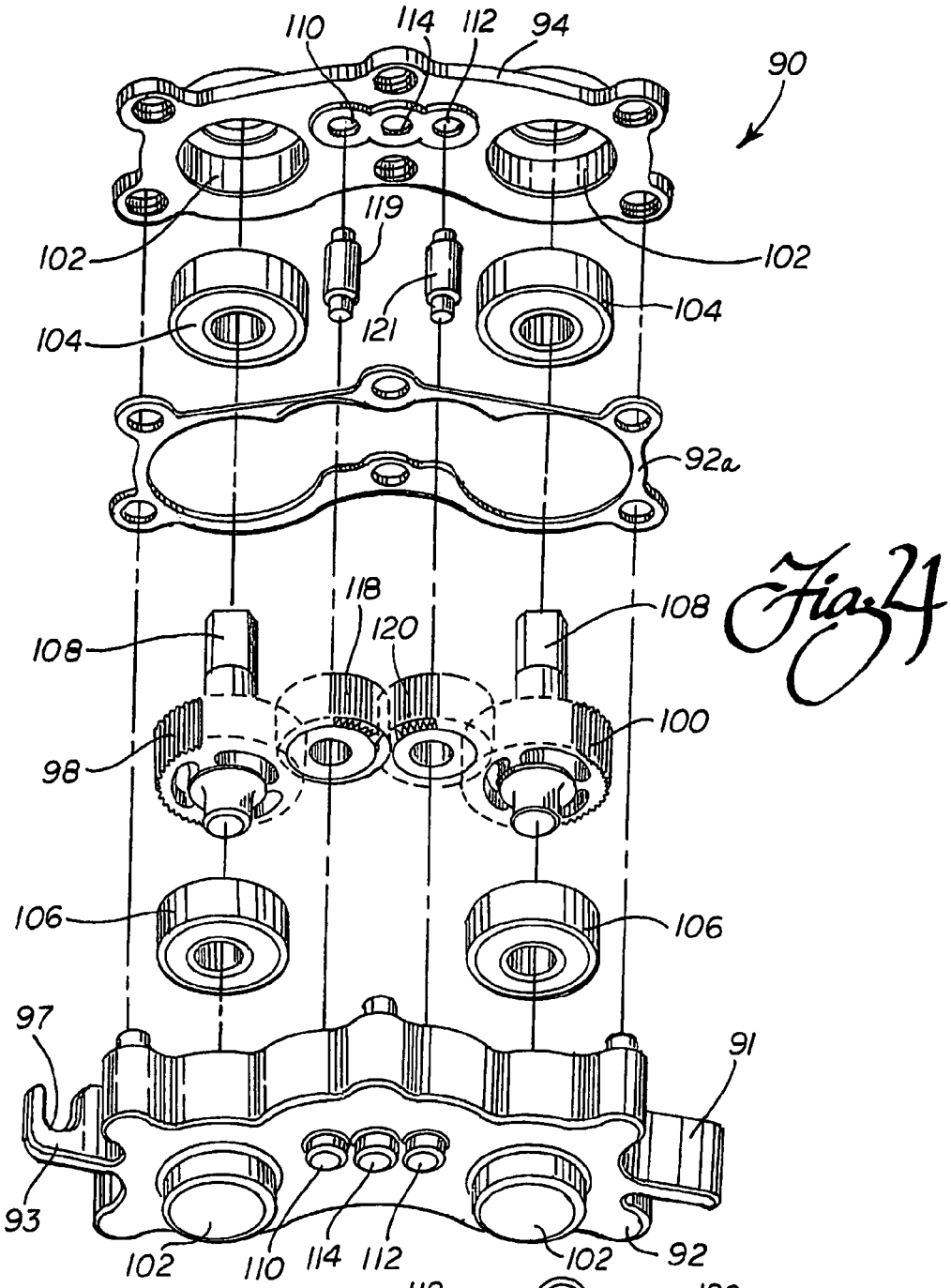
Figure 24A:
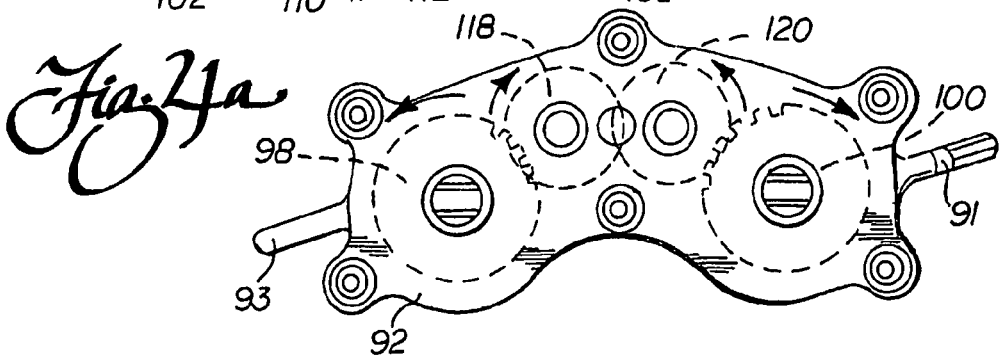
Figure 5:
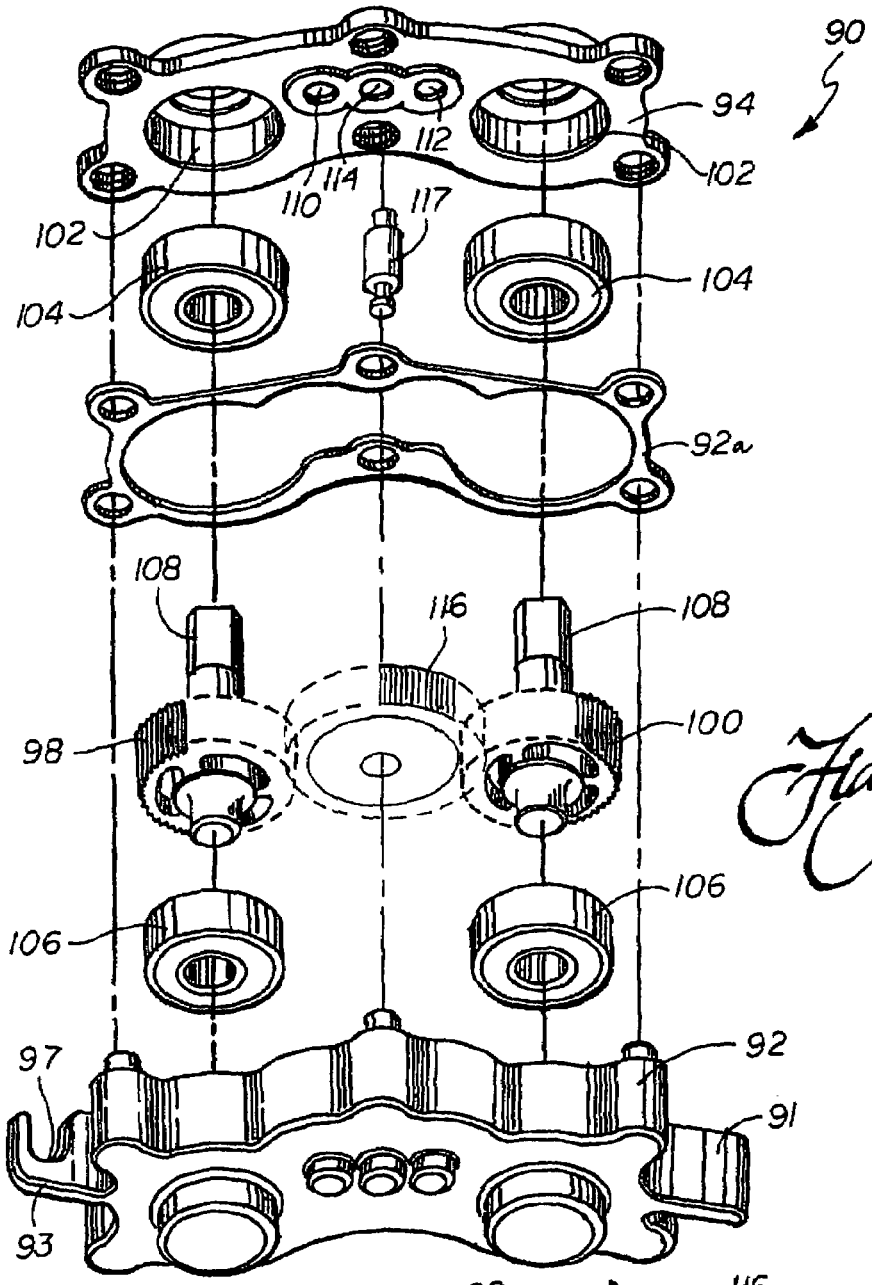
FIG. 5 is an exploded perspective view of the gear drive assembly with the single intermediate gear arrangement whereby the rotary agitators are driven in co-rotating fashion.
Figure 5A:
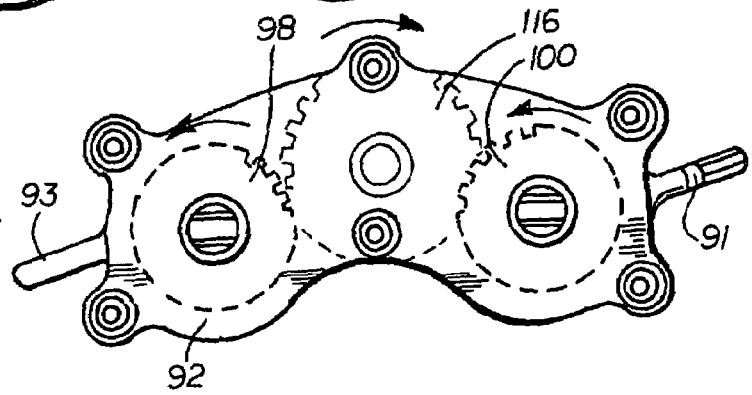
FIG. 5*a* is a side elevational partially schematic view showing the rotary motion of the gears and the agitators.

The agitator drive system 60 also incorporates the bare floor switch assembly 11 of the present invention. As best shown in FIG. 3*c*, the bare floor switch assembly 11 includes an idler pulley 72 carried for relative rotation on the post 71 of the pulley arm 74. Pulley arm 74 is pivotally mounted by a knurled pin 75 to the mounting bracket 76 secured to the nozzle assembly 14. As illustrated, the mounting bracket 76 includes a pair of spaced upstanding posts 78 upon which the switch body 80 is pivotally mounted by means of a pivot pin 82. The switch body 80 includes a pair of spaced mounting skirts 83 and a downwardly depending finger 84. Cavities formed between each of the mounting skirts 83 and the finger 84 receive the upper ends of the upstanding posts 78. The pivot pin 82 is received in aligned cooperating apertures in the upstanding posts 78, skirts 83 and finger 84. A decorative and user friendly switch plate fascia 79 may be mounted on the switch body 80 by means of a cooperating screw fastener 79*a*.

The pulley arm 74 includes and carries a leaf spring 86. Leaf spring 86 is secured to the pulley arm 74 at its proximal end which is received in a cooperating slot or socket 87. When the bare floor switch assembly 11 is in the agitator engaging position for powering the rotary agitator for carpet cleaning (see FIG. 3*a*), the rounded tip or cam end 89 of the finger 84 engages and presses downwardly on the leaf spring 86 thereby forcing the pulley arm 74 downwardly. As a consequence the idler pulley 72 is in a position of engagement with the second belt 66 so as to provide the necessary belt tension to transmit the rotary motion of the drive pulley 62 to the first rotary agitator 38*a*. As should be appreciated, the finger 84 moves "over center" along the face of the leaf spring 86 and thereby locks the pulley arm 74 in the drive-engaging position.

Figure 6:
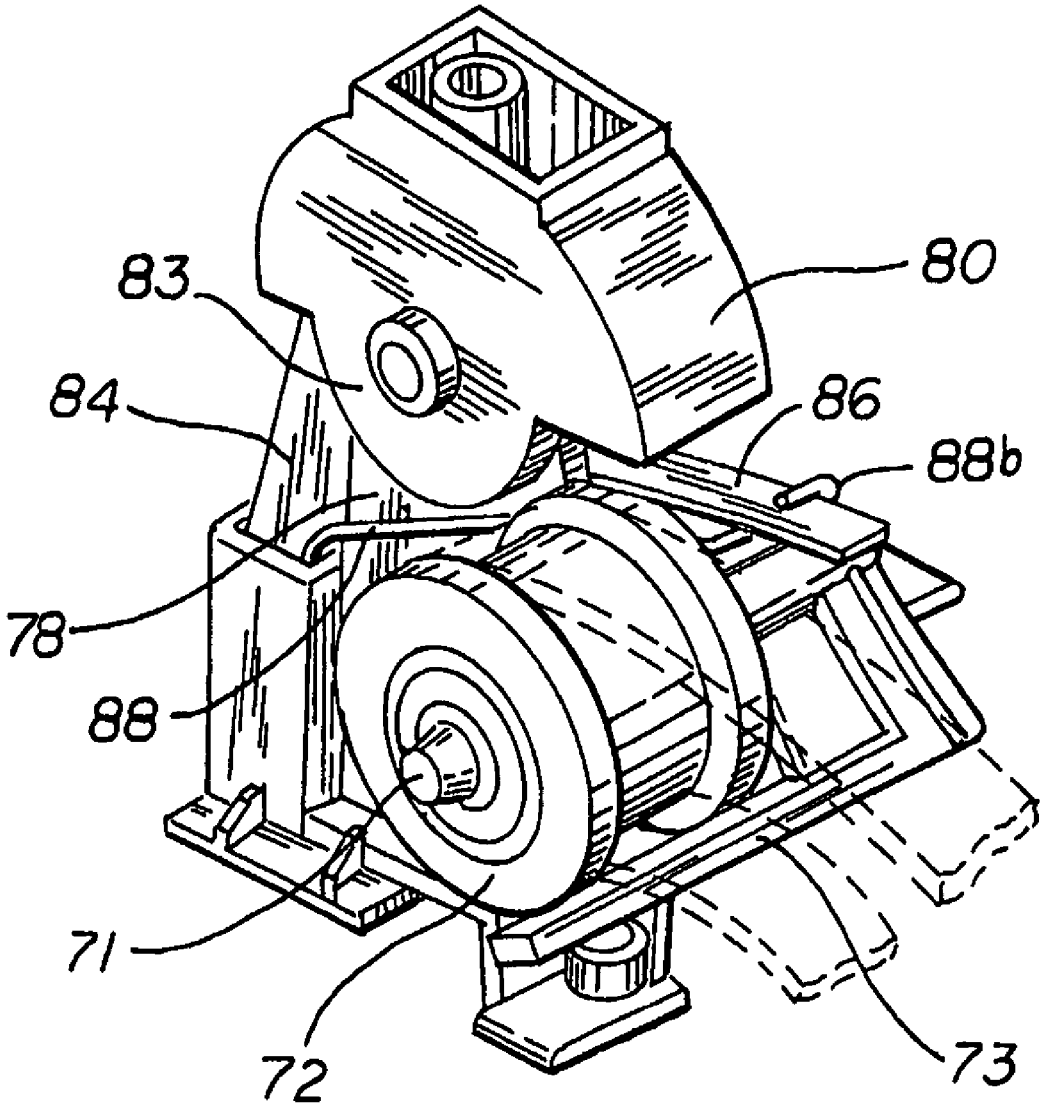
FIG. 6 is a perspective view of the pulley arm of the bare floor shifter assembly of the invention.

In contrast, in the bare floor or agitator drive-disengaging position of the bare floor switch assembly 11 shown in the FIG. 3*b*, finger 84 slips over center along the leaf spring 86. A biaser 88, (illustrated as a spring in the drawing figures) is positioned with a proximal end 88*a* captured between the mounting bracket 76, the pulley arm 74 and the pin 75. The distal end of the biasing spring 88 includes a hook 88*b* that receives and slides along the leaf spring 86. Through engagement with the leaf spring 86, the biasing spring 88 biases the pulley arm 74 upwardly to a second position where the idler pulley 72 is disengaged from the second belt 66. This releases tension on the second belt 66. A rib or upwardly projecting ledge R carried on or formed in the nozzle assembly 14 and a belt support 73 carried on the arm 74 (see also FIG. 6) engages the detensioned belt 66 forcing the slack toward the drive shaft 61 so that the belt is no longer in contact with the rotating drive shaft. This interrupts drive to the first rotary agitator 38*a*.

As should be appreciated thus far, only the first rotary agitator 38*a* is driven by the second belt 66. The second rotary agitator 38*b* is driven through a gear drive assembly generally designated by reference numeral 90. As best shown in drawing FIGS. 4, 4*a*, 5 and 5*a*, gear drive assembly 90 includes a gear box 92, a gasket 92*a* and a cooperating cover 94. Gear box 92 includes a projecting lug 91 adjacent a first end thereof and a projecting mounting flange 93 adjacent a second, opposite end thereof. The projecting lug 91 is received and captured in a cooperating slot 95 in the housing of the nozzle assembly 14 (see FIG. 2). The mounting flange 93 includes a slot 97 for receiving a screw fastener (not shown) which engages in a threaded aperture in the housing of the nozzle assembly 14 to complete the connection of the gear drive assembly 90 to the housing.

The gear box 92 holds a first drive gear 98 connected to the first rotary agitator 38*a* and a second drive gear 100 connected to the second rotary agitator 38*b*. More specifically, the gear box 92 and cover 94 each include cooperating cavities 102 for receiving respective bearings 104 and 106 between which the first and second drive gears 98, 100 are positioned. As further shown, each of the drive gears 98, 100 includes a projecting stub shaft 108 that is slotted, notched or otherwise keyed to the body of the agitators 38*a*, 38*b* respectively.

As further shown with reference to drawing FIG. 4, the gear box 92 and cover 94 include three pairs of sockets 110, 112, 114 each adapted to receive intermediate gears 116, 118, 120 respectively. In a first selected operational arrangement, the first and second pairs of sockets 110, 112, respectively, receive and hold for relative rotation two intermediate gears 118, 120, on shafts 119, 121 respectively. The intermediate gear 118 meshes with the first drive gear 98 and the intermediate gear 120 while the intermediate gear 120 meshes with the intermediate gear 118 and the second drive gear 100.

Accordingly, as the second belt 66 rotates the first rotary agitator 38*a* and drive gear 98 in a counterclockwise direction as illustrated in the drawing FIGS. 3*b* and 4*a*, intermediate gear 118 is rotated in a clockwise direction, intermediate gear 120 is rotated in a counterclockwise direction and the second drive gear 100 and second rotary agitator 38*b* keyed thereto are rotated in a clockwise direction. Thus, when two intermediate gears 118, 120 are provided as illustrated in drawing FIGS. 4 and 4*a*, the rotary agitators 38*a*, 38*b* are counter-rotating. Thus, in the embodiment illustrated the agitat rotate toward each other and brush dirt and debris upward from the surface being cleaned into the nozzle assembly 14 through the gap between the agitators. This provides excellent cleaning action.

It should be further appreciated that the agitators 38*a*, 38*b* are rotated at the same speed and as such the tendency of the first rotary agitator 38*a* to push the vacuum cleaner rearward is fully and equally offset by the tendency of the second rotary agitator 38*b* to pull the vacuum cleaner forward. Accordingly, the rotary agitators 38*a*, 38*b* have no net pushing or pulling effect upon the vacuum cleaner which in the absence of their influence may be more easily manipulated and guided as desired by the operator.

While counter-rotation of the agitators 38*a*, 38*b* toward each other has been illustrated in the drawing FIGS. 4, 4*a*, it should be appreciated that the counter-rotating agitators may also be operated in the reverse direction if desired so that dirt and debris is brushed from the surface being cleaned in opposing directions for drawing up through the nozzle assembly 14 in front of and behind the rotary agitators 38*a*, 38*b*.

Still further, it should be appreciated that the gear drive assembly 90 may also be set up to provide co-rotating agitators 38*a*, 38*b*. More specifically, in the arrangement shown in FIGS. 5 and 5*a*, the intermediate gear 116 is rotatably mounted on a shaft 117 in the third pair of sockets 114 between the first drive gear 98 and the second drive gear 100. The intermediate gear 116 meshes with both of the drive gears 98, 100. Thus, in the event the first rotary agitator 38*a* is driven by the motor 35 in a counterclockwise direction as illustrated in drawing FIG. 5*a*, the intermediate gear 116 is driven in a clockwise direction. This causes the second drive gear 100 to also be driven in a counterclockwise direction and, accordingly, the first and second rotary agitators 38*a*, 38*b* are co-rotating. Of course, while the co-rotating of the agitators in a counterclockwise direction is illustrated, it should be appreciated that the two agitators may also be co-rotated in a clockwise direction if desired.

By providing a gear drive assembly 90 for driving the second rotary agitator 38*b* off of the first rotary agitator 38*a*, belt drive need only be provided to the first rotary agitator. This advantageously eliminates complicated routing of the belt across both agitators. Further, it should be appreciated that more efficient and complete cleaning is possible than with a vacuum cleaner having both agitators driven by a single belt. This is because the pulley area of each agitator in such a design must be devoid of carpet cleaning structures. This leaves an unbrushed or unbeaten gap of carpet as the vacuum cleaner moves.

In contrast, while the first agitator 38*a* includes a belt pulley 68 and, therefore, cannot include any carpet cleaning structures such as beater bars, brushes, wipers or bristles in the pulley area, the second agitator 38*b* includes such cleaning structures across its entire width including, particularly the area 69 immediately aligned with the belt pulley 68 (see FIG. 2 and note bristle tufts 130). This provides for complete, highly efficient cleaning. There is no pulley area gap in the present invention and as a consequence, there is no unbrushed or unbeaten gap of carpet when the vacuum cleaner is moved to and fro.

In summary, numerous benefits result from employing the concepts of the present invention. The bare floor switch assembly 11 provides smooth and precise switching action between bare floor cleaning and carpet cleaning positions. The cooperating finger 84 and leaf spring 86 serve to provide this precise switching in a reliable and dependable fashion over a long service life. Advantageously, these benefits are achieved in an assembly of relatively simple and inexpensive construction that is easy to manufacture.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the belt and pulley assembly could comprise a pulley on the motor drive shaft, a pulley on the agitator and a single belt between these two pulleys.

Of course, while the bare floor switch assembly is illustrated for use on a vacuum cleaner equipped with dual agitators it is equally applicable to vacuum cleaners equipped with a single agitator or three or more agitators as well. The bare floor switch assembly could also be utilized on a power head of a canister vacuum cleaner equipped with a rotary agitator, a rotary agitator drive motor and a belt and pulley power transmission system.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A bare floor switch assembly for a powered rotary agitator, comprising:

a mounting bracket;

an idler and idler arm including an arcuate leaf spring and said finger engages a face of said arcuate leaf spring, said idler and idler arm pivotally mounted to said mounting bracket and displaceable between a rotary agitator drive-disengaging position and a rotary agitator drive-engaging position;

a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position.

2. The bare floor switch assembly of claim 1, wherein said arcuate leaf spring includes a proximal end and a free distal end.

3. The bare floor switch assembly of claim 2, wherein said idler and idler arm also includes a belt support.

4. The bare floor switch assembly of claim 1, wherein said mounting bracket includes a base and a pair of upstanding posts.

5. The bare floor switch assembly of claim 4, wherein said switch body includes a pair of spaced mounting skirts and said projecting finger extends between said pair of upstanding posts.

6. The bare floor switch assembly of claim 5, further including a pivot pin received in cooperating aligned apertures in said pair of spaced mounting skirts, said projecting finger and said pair of spaced upstanding posts.

7. The bare floor switch assembly of claim 1, further including a switch plate fascia connected to said switch body.

8. The bare floor switch assembly of claim 7, including a fastener for securing said switch plate fascia to said switch body.

9. The bare floor switch assembly of claim 1, wherein said biaser is a spring.

10. An upright vacuum cleaner, comprising:

a housing;

a nozzle opening in said housing;

a dust collector carried on said housing;

a suction fan connected to said housing, said suction fan drawing air, dirt and debris from a surface to be cleaned, through the nozzle opening to said dust collector;

a rotary agitator carried on said housing;

a drive motor carried on said housing;

a belt and pulley assembly connecting said drive motor to said rotary agitator; and a bare floor switch assembly including a mounting bracket; an idler and idler arm pivotally mounted to said mounting bracket and displaceable between a rotary agitator drive-disengaging position and a rotary agitator drive-engaging position, wherein said idler and idler arm includes an arcuate leaf spring and said finger engages a face of said arcuate leaf spring;

a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position.

11. The upright vacuum cleaner of claim 10, wherein said arcuate leaf spring includes a proximal end and a free distal end.

12. The upright vacuum cleaner of claim 11, wherein said idler and idler arm also includes a belt support.

13. The upright vacuum cleaner of claim 10, wherein said mounting bracket includes a base and a pair of upstanding posts.

14. The upright vacuum cleaner of claim 13, wherein said switch body includes a pair of spaced mounting skirts and said projecting finger extends between said pair of upstanding posts.

15. The upright vacuum cleaner of claim 14, further including a pivot pin received in cooperating aligned apertures in said pair of spaced mounting skirts, said projecting finger and said pair of spaced upstanding posts.

16. The upright vacuum cleaner of claim 10, further including a switch plate fascia connected to said switch body.

17. The upright vacuum cleaner of claim 16, including a fastener for securing said switch plate fascia to said switch body.

18. The upright vacuum cleaner of claim 10, wherein said biaser is a spring.

19. A power head for a vacuum cleaner, comprising:

a housing;

a nozzle opening in said housing;

a rotary agitator carried by said housing;

an agitator drive motor carried by said housing;

a belt and pulley assembly connecting said drive motor to said agitator; and a bare floor switch assembly including a mounting bracket; an idler and idler arm pivotally mounted to said mounting bracket and displaceable between a rotary agitator drive-disengaging position and a rotary agitator drive-engaging position, wherein said idler and idler arm includes an arcuate leaf spring and said finger engages a face of said arcuate leaf spring; a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position.

20. The power head of claim 19, wherein said arcuate leaf spring includes a proximal end and a free distal end.

21. The power head of claim 20, wherein said idler and idler arm also includes a belt support.

22. The power head of claim 19, wherein said mounting bracket includes a base and a pair of upstanding posts.

23. The power head of claim 22, wherein said switch body includes a pair of spaced mounting skirts and said projecting finger extends between said pair of upstanding posts.

24. The power head of claim 23, further including a pivot pin received in cooperating aligned apertures in said pair of spaced mounting skirts, said projecting finger and said pair of spaced upstanding posts.

25. The power head of claim 19, further including a switch plate fascia connected to said switch body.

26. The power head of claim 25, including a fastener for securing said switch plate fascia to said switch body.

27. The of claim 19, wherein said biaser is a spring.

28. A bare floor switch assembly for a powered rotary agitator, comprising:

a mounting bracket including a base and a pair of upstanding posts;

an idler and idler arm pivotally mounted to said mounting bracket and displaceable between a rotary agitator drive-disengaging position and a rotary agitator drive-engaging position;

a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position, said switch body further including a pair of spaced mounting skirts and said projecting finger extends between said pair of upstanding posts.

29. The bare floor switch assembly of claim 28, wherein said idler and idler arm also includes a belt support.

30. The bare floor switch assembly of claim 28, further including a pivot pin received in cooperating aligned apertures in said pair of spaced mounting skirts, said projecting finger and said pair of spaced upstanding posts.

31. The bare floor switch assembly of claim 28, wherein said biaser is a spring.

32. A bare floor switch assembly for a powered rotary agitator, comprising:

a mounting bracket;

an idler and idler arm pivotally mounted to said mounting bracket and displaceable between a rotary agitator drive-disengaging position and a rotary agitator drive-engaging position;

a biaser biasing said idler and idler arm to said rotary agitator drive-disengaging position;

a switch body pivotally mounted to said mounting bracket, said switch body including a projecting finger for engaging and locking said idler and idler arm in said rotary agitator drive-engaging position; and a switch plate fascia connected to said switch body.

33. The bare floor switch assembly of claim 32, wherein said idler and idler arm also includes a belt support.

34. The bare floor switch assembly of claim 32, wherein said mounting bracket includes a base and a pair of upstanding posts.

35. The bare floor switch assembly of claim 34, wherein said switch body includes a pair of spaced mounting skirts and said projecting finger extends between said pair of upstanding posts.

36. The bare floor switch assembly of claim 35, further including a pivot pin received in cooperating aligned apertures in said pair of spaced mounting skirts, said projecting finger and said pair of spaced upstanding posts.

37. The bare floor switch assembly of claim 32, including a fastener for securing said switch plate fascia to said switch body.

38. The bare floor switch assembly of claim 32, wherein said biaser is a spring.

39. An upright vacuum cleaner, comprising:

a housing;

a nozzle opening in said housing;

a dust collector carried on said housing;

a suction fan connected to said housing, said suction fan drawing air, dirt and debris from a surface to be cleaned, through the nozzle opening to said dust collector;

a rotary agitator carried on said housing;

a drive motor carried on said housing;

a belt and pulley assembly connecting said drive motor to said rotary agitator; and a bare floor switch assembly including a mounting bracket having a base and a pair of upstanding posts; an idler and idler arm pivotally mounted to said mounting bracket and displaceable between a rotary agitator drive-disengaging position and a rotary agitator drive-engaging position; a biaser biasing said idler and idler arm to said rotary agitator drive-disengaging position; and a switch body including a pair of spaced mounting skirts and said projecting finger extends between said pair of upstanding posts, said switch body pivotally mounted to said mounting bracket, said switch body including a projecting finger for engaging and locking said idler and idler arm in said rotary agitator drive-engaging position.

40. The upright vacuum cleaner of claim 39, wherein said idler and idler arm also includes a belt support.

41. The upright vacuum cleaner of claim 39, further including a pivot pin received in cooperating aligned apertures in said pair of spaced mounting skirts, said projecting finger and said pair of spaced upstanding posts.

42. The upright vacuum cleaner of claim 39, wherein said biaser is a spring.

43. An upright vacuum cleaner, comprising:

a housing;

a nozzle opening in said housing;

a dust collector carried on said housing;

a suction fan connected to said housing, said suction fan drawing air, dirt and debris from a surface to be cleaned, through the nozzle opening to said dust collector;

a rotary agitator carried on said housing;

a drive motor carried on said housing;

a belt and pulley assembly connecting said drive motor to said rotary agitator;

a bare floor switch assembly including a mounting bracket; an idler and idler arm pivotally mounted to said mounting bracket and displaceable between a rotary agitator drive-disengaging position and a rotary agitator drive-engaging position;

a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position; and a switch plate fascia connected to said switch body.

44. The upright vacuum cleaner of claim 43, wherein said idler and idler arm also includes a belt support.

45. The upright vacuum cleaner of claim 43, wherein said mounting bracket includes a base and a pair of upstanding posts.

46. The upright vacuum cleaner of claim 45, wherein said switch body includes a pair of spaced mounting skirts and said projecting finger extends between said pair of upstanding posts.

47. The upright vacuum cleaner of claim 46, further including a pivot pin received in cooperating aligned apertures in said pair of spaced mounting skirts, said projecting finger and said pair of spaced upstanding posts.

48. The upright vacuum cleaner of claim 44, including a fastener for securing said switch plate fascia to said switch body.

49. The upright vacuum cleaner of claim 44, wherein said biaser is a spring.

50. A power head for a vacuum cleaner, comprising:

a housing;

a nozzle opening in said housing;

a rotary agitator carried by said housing;

an agitator drive motor carried by said housing;

a belt and pulley assembly connecting said drive motor to said agitator; and a bare floor switch assembly including a mounting bracket having a base and a pair of upstanding posts; an idler and idler arm pivotally mounted to said mounting bracket and displaceable between a rotary agitator drive-disengaging position and a rotary agitator drive-engaging position; a biaser biasing said idler and idler arm to said rotary agitator drive-disengaging position; and a switch body including a pair of spaced mounting skirts and said projecting finger extends between said pair of upstanding posts, said switch body pivotally mounted to said mounting bracket, said switch body including a projecting finger for engaging and locking said idler and idler arm in said rotary agitator drive-engaging position.

51. The power head of claim 50, wherein said idler and idler arm also includes a belt support.

52. The power head of claim 50, further including a pivot pin received in cooperating aligned apertures in said pair of spaced mounting skirts, said projecting finger and said pair of spaced upstanding posts.

53. The power head of claim 50, further including a switch plate fascia connected to said switch body.

54. The power head of claim 50, including a fastener for securing said switch plate fascia to said switch body.

55. The power head of claim 50, wherein said biaser is a spring.

56. A power head for a vacuum cleaner, comprising:

a housing;

a nozzle opening in said housing;

a rotary agitator carried by said housing;

an agitator drive motor carried by said housing;

a belt and pulley assembly connecting said drive motor to said agitator;

a bare floor switch assembly including a mounting bracket; an idler and idler arm pivotally mounted to said mounting bracket and displaceable between a rotary agitator drive-disengaging position and a rotary agitator drive-engaging position; a biaser biasing said idler and idler arm to said rotary agitator drive-disengaging position; and a switch body pivotally mounted to said mounting bracket, said switch body including a projecting finger for engaging and locking said idler and idler arm in said rotary agitator drive-engaging position; and a switch plate fascia connected to said switch body.

57. The power head of claim 56, wherein said idler and idler arm also includes a belt support.

58. The power head of claim 56, wherein said mounting bracket includes a base and a pair of upstanding posts.

59. The power head of claim 58, wherein said switch body includes a pair of spaced mounting skirts and said projecting finger extends between said pair of upstanding posts.

60. The power head of claim 59, further including a pin received in cooperating aligned apertures in said pair of spaced mounting skirts, said projecting finger and said pair of spaced upstanding posts.

61. The power head of claim 56, wherein said biaser is a spring.

* * * * *